United States Patent [19]

Kaempfen

[11] 4,092,787

[45] June 6, 1978

[54] APPARATUS FOR TEACHING THE EXECUTION OF A SKI TURN ON SKIS

[76] Inventor: Adolf Kaempfen, 3, chemin du Connetable, Cologny pres, Geneva, Switzerland

[21] Appl. No.: 794,626

[22] Filed: May 6, 1977

[30] Foreign Application Priority Data

May 13, 1976 Switzerland ..... 6007/76

[51] Int. Cl.[2] ..... A63B 69/18

[52] U.S. Cl. ..... 35/29 R; 272/97

[58] Field of Search ..... 35/29 R, 29 A, 29 B, 35/29 C, 29 D, 29 E; 272/97

[56] References Cited

U.S. PATENT DOCUMENTS

| | | | |
|---|---|---|---|
| 2,402,109 | 6/1946 | Williams | 35/29 C |
| 2,504,318 | 4/1950 | Freeman | 35/29 C |
| 2,657,055 | 10/1953 | Denham | 272/97 |
| 3,159,400 | 12/1964 | Brass | 35/29 R X |
| 3,582,066 | 6/1971 | Keryluk | 272/97 |

FOREIGN PATENT DOCUMENTS

| | | | |
|---|---|---|---|
| 2,262,362 | 9/1975 | France | 272/97 |

*Primary Examiner*—Harland S. Skogquist

*Attorney, Agent, or Firm*—Haseltine, Lake & Waters

[57] ABSTRACT

Apparatus for teaching the technique of turning a ski comprising two plates, simulating skis, disposed in parallel, adjacent relation, each plate being provided with an assembly for secure support of a shoe thereon in that capability of sliding. Each plate is resiliently supported for undergoing two modes of movement, one mode being a raising and lowering movement responsive to weighting and unweighting the plate, the other mode being a pivotal movement of the plate about its longitudinal axis when the plate is lowered. The plates are associated with electrical switches in an electrical circuit having illuminating or other indicator devices for producing signals when the plates are properly weighted and unweighted and correspondingly pivoted around their longitudinal axes to simulate the conditions for executing a turn of the skis.

13 Claims, 9 Drawing Figures

APPARATUS FOR TEACHING THE EXECUTION OF A SKI TURN ON SKIS

FIELD OF THE INVENTION

The present invention relates to apparatus for teaching the execution of a ski turn.

BACKGROUND OF THE INVENTION

The mastery of the technique of ski turning requires, on practice, the automatic accomplishment of certain movements that the beginner finds difficult on the slope for the reason that his attention is divided between the movements to the accomplished with precision and the fear of slipping that he faces on the slope. This fear is paramount and any other instruction is useless as long as it is not overcome.

There has therefore been interest in being able to diassociate the factors of making the necessary movements automatic and the fear coming from a feeling of insecurity which produces the sliding sensation.

SUMMARY OF THE INVENTION

The apparatus, according to the present invention, achieves this objective by permitting the future skier to learn in his home how to correctly effect the proper movements in order to execute a ski turn.

These movements consist on the one hand, of shifting the weight of the body onto the downhill ski, that is to say, at the outside of the turn while unweighting the uphill ski, that is to say, at the interior of the turn and, on the other hand, of inclining the weighted ski, such that its interior edge at the turn thus bites into the snow. This is referred to as "setting an edge" and a preferably simultaneously effected at the start of the turn with rotation of the skis.

In order to achieve this, the apparatus according to the invention, comprises two plates placed side-by-side parallel to one another, each plate comprising means for supporting a shoe thereon without capability of sliding, means supporting each plate for resilient lifting and lowering movements in accordance with shift of weight on the plate and for inclination about a longitudinal axis through the plate, said plate being able to effect two movements against the action of an elastic force tending to raise it or to be able to lower it and to be able to oscilate it around it longitudinal axis, means being finally provided controlled by the said plate being eased off occupies its upper position whereas the other is simultaneously lowered and inclined in the direction of the first, two signals being preferably provided for the reason in the case where it is the left plate which is eased off and another for the case where it is the right plate which is eased off.

BRIEF DESCRIPTION OF THE DRAWING

The attached drawing shows in partially schematic fashion one embodiment of the invention given by way of example.

DETAILED DESCRIPTION

Figure 1:
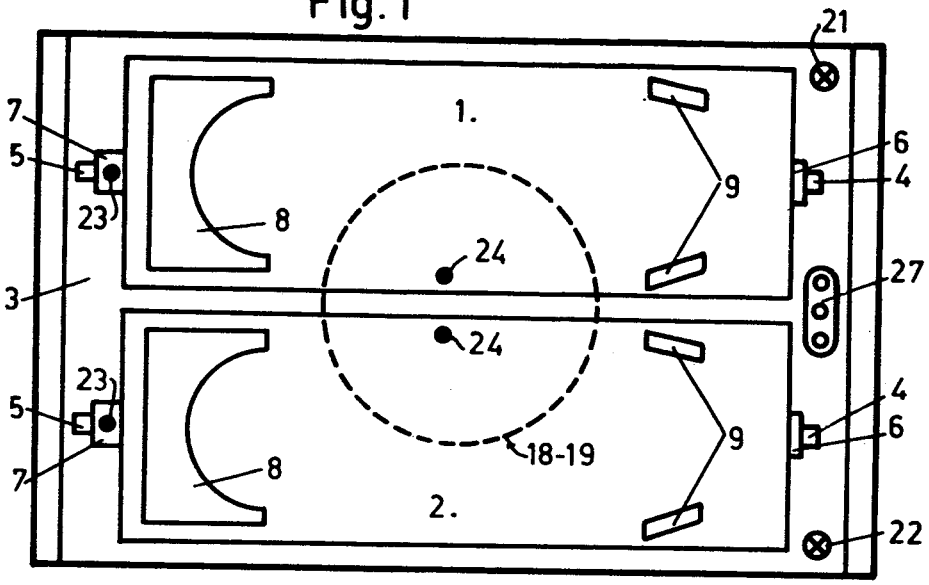
FIG. 1 is a plan view of the embodiment of the invention.
Figure 2:
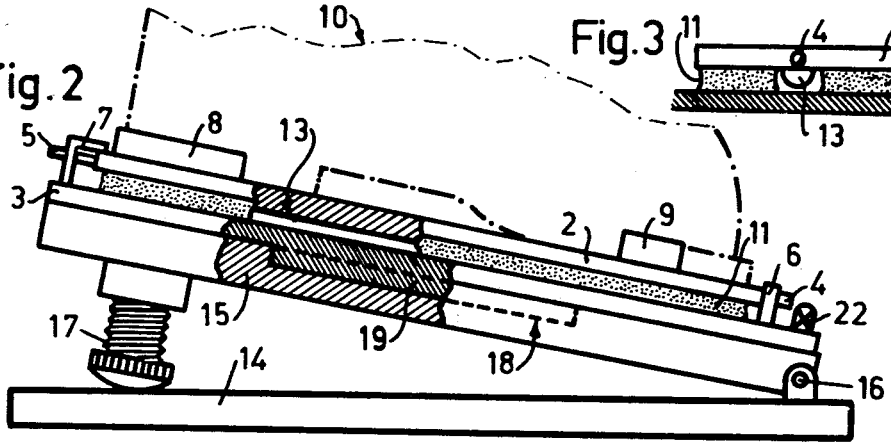
FIG. 2 is an elevational view thereof, partially in section.

The apparatus shown in FIGS. 1 and 2 comprises two plates 1 and 2 situated side-by-side and parallel to one another on a common plate 3 to which they are connected by shafts 4 and 5 which are mounted for rotation and displacement in supports 6 and 7 secured to the plate 3. The shafts are situated in alignment with the longitudinal axis of each plate.

On each plate is mounted a profiled member 8 and a pair of abutments 9 permitting the support of a shoe 10 in secured relation without capability of sliding either laterally or longitudinally.

Figure 9:
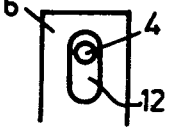
FIG. 9 is a detail of the attachment to allow the movement of the plate.

The two plates are elastically subjected to an elevating action by foam rubber members 11 against the resistance of which the plates can be lowered. The support shafts of the plates are housed for this purpose in elongated holes 12 in the supports 6 such as shown in FIG. 9 where the shaft 4 is seen in elongated hole 12.

Figure 3:
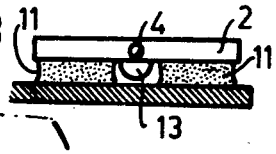
FIG. 3 is a partial end view.

The amplitude of the lowering movement of the plates is limited by an axial longitudinal rib 13 at the lower surface of each plate which can bear on the associated plate as seen in FIG. 3. Once this contact is achieved, the plate can oscillate to the right or to the left around its longitudinal axis, for which reason the hole 12 is not only longitudinally elongated but is also slightly wider than the shaft as seen in FIG. 9.

The assembly just described is placed on a frame including two parts 14, 15 articulated to one another at hinge 16 such that part 15 can be raised and constitutes an inclined plane with respect to part 14, which inclined plane constitutes the base on which the assembly rests. This inclination is variable and adjustable by means of a bolt 17.

At its center, the inclined part 15 has a circular recess 18 in which a boss 19 of corresponding shape is engaged. The boss 19 is formed on the plate 3 which can thus turn in its plane.

The beginner having placed his left foot on the plate 1, and his right foot on the plate 2 can thus freely execute the following movements:

1. increase or decrease his weight on each plate thereby lowering or raising the same.
2. oscillate each lowered plate around its longitudinal rib 13, i.e. set the edge of the ski left or right, or stated otherwise to the exterior or to the interior.
3. turn the assembly of the two plates in their plane simulating the rotation beginning a right turn (FIG. 4) or a left turn (FIG. 5) with respect to the direction of presumed travel (arrow 20) represented by the inclination of the part 15 of the frame.

However, as previously noted the mastery of the turn requires unweighting the upstream ski while concurrently increasing the weight on the downstream ski, and at the same time inclining the ski more or less to set the edge of the skis according to the condition of the snow.

Figure 4:
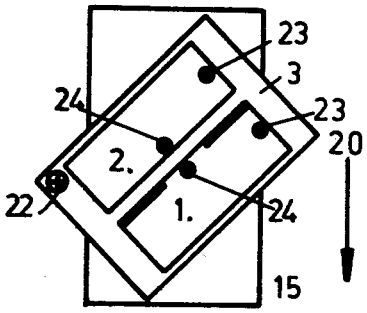
FIGS. 4 and 5 are plan views showing the position of the plates at the time of a turn to the right and to the left respectively.

FIG. 4 corresponds to a left turn, the plate 2 being unweighted and the plate 1 weighted and inclined such that its interior edge producing the maximum contact is lowered.

Figure 5:
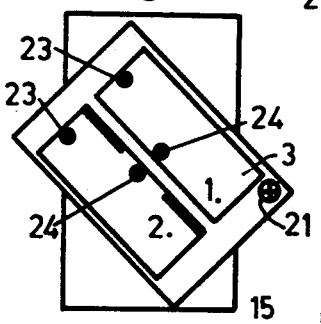

The exact opposite is true in the case of turning to the left as shown in FIG. 5.

The described apparatus has the objective of permitting the control of the movements and indicating the smallest error and the illustrated embodiment is provided with luminous signals constituted by two lamps 21 and 22 controlled by electrical circuits (that are going to be described) such that the lamp situated on the side where it is visible to the student is illuminated each time that the required conditions for the turn are perfectly fulfilled.

Each plate in this regard is associated with two electrical switches 23, 24, switch 23 being closed when the weight on the plate is reduced and switch 24 being closed when the plate is correctly inclined to set the edge.

Figure 7:
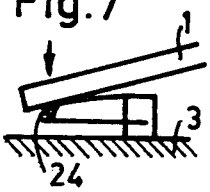
FIGS. 7 and 8 show the electrical contacts mounted for operation in the case of FIG. 6.
Figure 8:
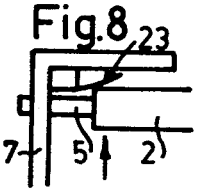

FIGS. 7 and 8 schematically show these switches.

In FIG. 7 it is seen that the two blades constituting the switch 24 of the plate 2 close the circuit when this plate is correctly inclined in the direction of the arrow.

In FIG. 8 the switch 23 is situated in the support 7 of the plate 1 and is closed when the plate occupies its raised position (in the direction of the arrow).

These two positions correspond to a turn to the right and to illumination of the lamp 22.

Figure 6:
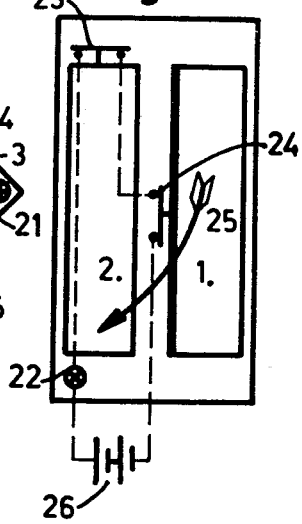
FIG. 6 shows an electrical circuit producing a signal corresponding to a right turn.

The electrical circuit of FIG. 6 shows how a turn to the right (arrow 25) and illuminates the lamp 22 by closing the circuit including the battery 26, the contacts of switch 24 of the plate 1 and the switch 23 by reducing weight on the plate 22.

The circuit associated with a turn to the left is identical and symmetrical to that which we have just described fed by the same battery.

It is understood that the control of the turn could be detected by lighting exterior lamps instead of the interior ones or the lamps could even be constantly illuminated and they could be extinguished which would necessitate a reverse operation of the switches. It is also obvious that any other embodiment for signaling could be provided, for example, an accoustical device.

The disposition of the luminous signals on the apparatus close to the feet can present the disadvantage of requiring the student skier to direct his attention towards the ground which must be avoided. For this reason one can provide the apparatus with a plug 27 permitting connection thereat of a cord having three conductors terminating at two lamps capable, for example, of being suspended at eye level. One thus could replace the lamps 21 and 22 by small spots projecting luminous points on a wall.

With regard to the rotation of the plate 3 on the support, it is possible to provide means, hereat for modifying the friction, i.e. the force necessary to obtain the rotation as is realized in the case according to the properties of the snow.

The apparatus can be made of any suitable material, such as, wood and molded members of plastic or light weight metal.

The elastic members 11 of foam rubber could also be replaced by any other material having the desired properties or even by springs.

What is claimed is:

1. Apparatus for teaching the technique of turning a ski, comprising left and right plates placed side by side in parallel relation to one another, each plate including means for supporting a shoe without capability of sliding, means supporting each plate for resilient lifting and lowering movements in accordance with shift of weight on the plate and for inclination about a longitudinal axis through the plate, and means responsive to the movement of said plates for producing a signal each time that one of the plates is unweighted and occupies a raised position while the other plate is weighted and simultaneously lowered and inclined about its longitudinal axis in the direction of the first plate.

2. Apparatus as claimed in claim 1 wherein said means for producing a signal includes indicators for producing two signals one when the left plate is unweighted and the other when the right plate is unweighted.

3. Apparatus as claimed in claim 2 wherein said signals are luminous signals.

4. Apparatus as claimed in claim 2 wherein said indicators are lamps.

5. Apparatus as claimed in claim 4 wherein said means for producing a signal comprises an electrical circuit.

6. Apparatus as claimed in claim 5 wherein said circuit has a plug permitting remote attachment thereto of said lamps.

7. Apparatus as claimed in claim 1 wherein said means supporting each plate includes an elastic member.

8. Apparatus as claimed in claim 7 wherein said elastic member is foam rubber.

9. Apparatus as claimed in claim 1 wherein said means supporting each plate comprises a main plate, each of the left and right plates having a lower surface with a rib thereon facing said main plate and normally spaced therefrom, said ribs coming into contact with said main plate when the associated left and right plates are lowered to allow the respective left and right plates to rotate around their longitudinal axis.

10. Apparatus as claimed in claim 9 comprising a frame supporting said main plate for rotation in its own plane.

11. Apparatus as claimed in claim 10 wherein said frame includes a first support part, and a second part pivotable and said first part and supporting said main plane for rotation in its plane.

12. Apparatus as claimed in claim 11 comprising means for adjustably supporting said second part on said first part for varying the angle of inclination of said second part with respect to said first part.

13. Apparatus as claimed in claim 5 wherein said electrical circuit comprises first and second branches each connected to a power source and including first and second switches, the first switch being associated with a first plate for being closed depending on the raised or lowered state thereof, the second switch being associated with the second plate for being closed depending on the inclined position thereof in the direction of the first plate.

* * * * *